United States Patent [19]

Busch et al.

[11] 4,090,727

[45] May 23, 1978

[54] HALF-TURN ACTUATED MEMBER

[75] Inventors: Kieran Busch, Gloversville; Cuyler Hoen, Rennesselaer, both of N.Y.

[73] Assignee: Simmons Fastener Corporation, Albany, N.Y.

[21] Appl. No.: 800,231

[22] Filed: May 25, 1977

[51] Int. Cl.[2] ..... E05C 3/16

[52] U.S. Cl. ..... 292/11

[58] Field of Search ..... 292/111, 113, 114, 65, 292/66, 69, 197, 200, 124, 126

[56] References Cited

U.S. PATENT DOCUMENTS 2,486,686 11/1949 Schreve ..... 292/111

2,820,995 1/1958 Schlueter ..... 292/111 X

*Primary Examiner*—Richard E. Moore

*Attorney, Agent, or Firm*—Eliot S. Gerber

[57] ABSTRACT

A locking industrial fastener comprises a hook-like keeper plate member having a keeper lip to be attached to one panel and a turn hasp member attached to another panel. The turn member comprises a sleeve member hinged to a fastening plate, a slide member which telescopically slides in the sleeve member, a cam pin operable in a cam opening in the sleeve member, a first disk rotatable in a circular opening in the sleeve member, a second disk fixed to the first disk, a spring disk fixed to the other disks, and a turning means.

8 Claims, 13 Drawing Figures

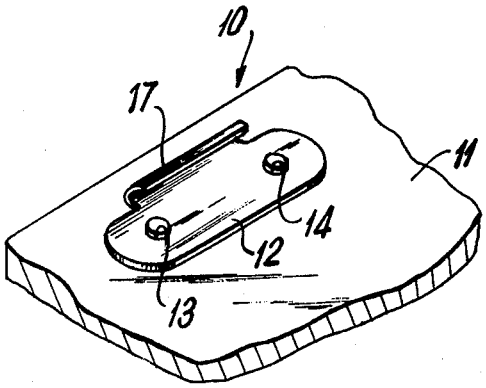
FIG. 1
FIG. 2
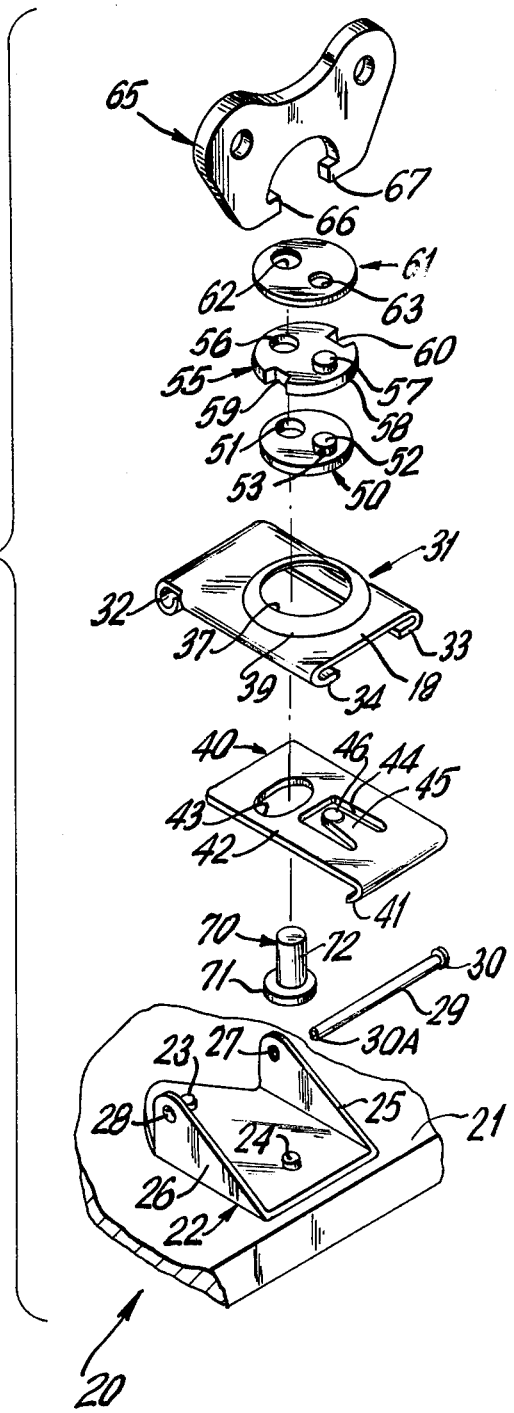

HALF-TURN ACTUATED MEMBER

BACKGROUND OF THE INVENTION

The present invention relates to industrial fasteners and more particularly to those industrial fasteners that are used to pull and secure two panels together.

At the present time there are a number of industrial fasteners commercially available to pull and secure together two panels, for example, two panels which meet in a butt joint. The panels may be, for example, portable enclosures, packing cases, instrument cases, transit cases, trunks, and other packages. Generally such fasteners consist of two separated members, each one of which is attached to one of the panels. For example, one panel may be a container lid and the other panel the container body. Such fasteners may be used to obtain a tight seal and may be used to compress a gasket positioned between the two panels.

Two types of industrial fasteners are shown in U.S. Pat. No. 2,853,751 and U.S. Pat. No. 2,853,752, both to Ernest Schlueter and both assigned to Simmons Fastener Corp. U.S. Pat. No. 2,820,995 to Ernest Schlueter describes a "spring loaded link lock fastener" in which a hasp member is mounted on a spring wire pivot. An eccentric pin 66 is integral with a bolt 60 and engages in a transverse slot 68. The bolt is a solid member, for example, a relatively expensive casting, see FIG. 6 therein.

Although the presently commercially available fasteners are satisfactory for many purposes, there has been a need for a suitable fastener which would be rugged and which would operate under adverse environments and yet which would not be relatively expensive or relatively complex. For example, an industrial fastener utilized on an instrument case for an electronic device for the military may be required to exert 90 lbs. of pulling pressure to pull down the case lid and be capable of resisting 300 pounds of tension, tending to separate the lid. In addition, such a fastener is required to be able to be operated in arctic temperatures of 70° F. below zero and resist damage due to impact and dropping.

SUMMARY OF THE INVENTION

The present invention provides an industrial fastener in two members. The first member is a hook-like keeper plate member (engagement latch) which may be secured to one panel; for example, it may be secured to the lid of a container. The second member is a turn member which is an actuator secured to another panel; for example, it may be secured to the body of the container.

The turn member actuator includes a hook-like lip portion which may be removably engaged with the curved portion hook-like lip portion of the hook-like member. A rotary member for example, a turning means having wing handles, of the turn member is given a ½ turn (180°) to pull and lock the two panels together.

The turn member comprises a number of parts, each of which may be formed from sheet metal, plated and heat-treated prior to assembly. Those parts include a base member which is a pivot carrying plate, a sleeve member (hasp member) hinged to the base, and a slide member which telescopically slides in the sleeve member and may be extended or withdrawn. A turning means has fingers held in opposed indentations in a disk which disk is held between a spring steel disk and another disk. The third-mentioned disk rotates in a hole in the sleeve member. A rivet holds the sleeve member, slide and the three disks together. The three disks are locked so that they rotate together by bosses which fit into, respectively, an indentation and a hole. When the turning means is turned, it turns the disks, as a unit, and the rivet. The rivet is offset and eccentric with respect to the center of movement ofthe disks and is within a cam slot of the slide so that the shank of the rivet cams the slide member, either to extend or to withdraw the slide member.

FEATURES OF THE INVENTION

It is a feature of the present invention to provide an industrial fastener comprising a hook-like member to be fastened to one panel and a turn member to be fastened to another panel. The turn member comprises a base member, a sleeve member having a central portion having therein an opening and opposed side portions forming a sleeve, and hinge means connecting the base member and the sleeve member to permit turning motion of the sleeve member relative to said base member.

The turn member further comprises a slide member which slides within the sleeve, to be extended or withdrawn, and has a hook-like portion and an elongated cam opening. A first disk member of sheet metal, having a hole therethrough, fits within the opening in the sleeve member and is rotatable therein. A second disk member of sheet metal having opposed side indentations and a hole therethrough is attached to the first disk member. A third disk member of resilient steel and having a hole therethrough is attached to the second disk member.

A cam member is connected through the holes in the first disk member, said second disk member and said third disk member and connects the three disks together. The cam member also protrudes through the sleeve member opening and the cam opening.

The turn member further comprises turning means having finger portions which fit in the indentations and which turning means may be turned to move the cam member about the center of the sleeve member opening and within said cam opening. The cam member thereby slides and withdraws the slide member and pulls together the hook-like member and the turn member.

BRIEF DESCRIPTION OF THE DRAWINGS

Other features and objectives of the present invention will be apparent from the following detailed description of the invention which should be taken in conjunction with the accompanying drawings and which presents the inventors' best mode of carrying out the present invention.

In the drawings:

FIG. 1 is a perspective view of the hook-like member attached to a panel;

FIG. 2 is an exploded perspective view of the parts of the turn member of the industrial fastener of the present invention;

FIGS. 3–11 are views of parts of the turnable member in which FIGS. 3, 4, 5, 6, 7, 9 and 11 are top plan views of such parts;

FIG. 8 is an end plan view of the part shown in FIG. 7;

FIG. 10 is a side view of the part shown in FIG. 8; and

DETAILED DESCRIPTION OF THE INVENTION

Figure 3:
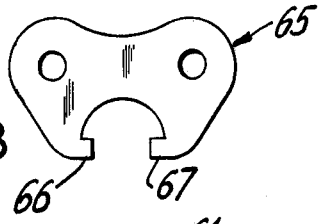

As shown in FIG. 1, the industrial fastener of the present invention has a hook-like member 10 which is attached to the first panel 11. For example, the panel 11 may be a portion of a lid of a container. The hook-like member 10 comprises a flat keeper plate portion 12 having two holes therethrough 13 and 14, and a curved turned-over hook-like keeper lip portion 17. The hook-like member 10 is attached to the panel by means of screws or other fastening devices inserted through the holes 13 and 14.

Figure 11:
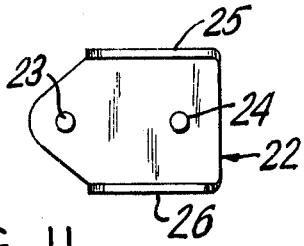
Figure 12:
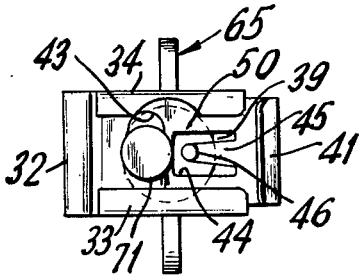
FIGS. 12 and 13 are bottom plan views showing the slide member in its withdrawn and its extended positions, respectively.
Figure 13:
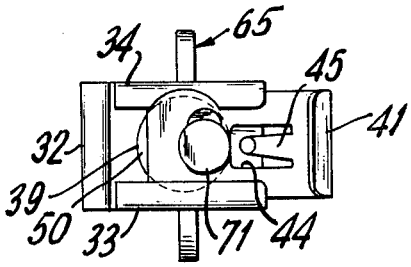

As shown in FIG. 2, the turn member 20 is adapted to be connected to a second panel 21. For example, the second panel may be the body portion of a container. The turn member 20 includes a base member 22, which is a pivot carrying plate, having holes 23 and 24 therethrough, see FIG. 11. The base member 22 is attached to the second panel by means of screws or other fastenings through the holes 23 and 24. The base member has side ear flange portions 25 and 26 at respectively opposite sides of the base member. The flange portions 25 and 26 each have a hole, a bearing aperture, therethrough, respectively 27 and 28, through which an elongated pin 29 is secured. The pin 29 has a head 30 at one of its ends, on the outside of the flange portion 25, and a peened-over portion 30A outside of the opposite flange portion 26.

Figure 7:
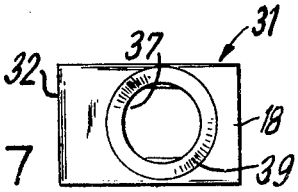
Figure 8:
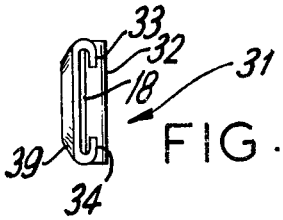

The turn member 20 further comprises a sleeve member 31, see FIGS. 7 and 8. The sleeve member 31 has, as integral portions thereof, a central portion 18 and a turned-over elongated tubular portion 32. The shank of the pin 29 fits within the tubular portion 32 so that the sleeve member 31 is hinged and rotatable about the pin 29. The hinge means (comprising pin 29, tubular portion 32, holes 27,28 and flange portions 25,26) permits turning motion of the sleeve member 31 relative to the base member.

The sleeve member 31 has two turned-over side edge flanges forming sleeve portions 33 and 34 on its opposite sides, the internal faces of which form a guideways. The sleeve member 31, at its central portion 18, includes a central circular opening 37 therethrough which is centered at a raised boss portion 39 and has an imaginary center. The sleeve member 31 is stamped from sheet metal, formed into its shape, and then plated and heat-treated after it is shaped. It will be noted that the sleeve member 31 may be completely formed, plated and heat-treated prior to assembly of the fastener.

Figure 9:
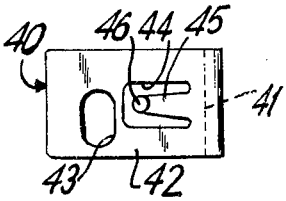
Figure 10:
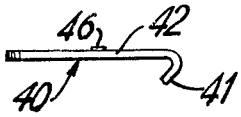

A slide member 40 fits and slides within two side sleeve portions 33 and 34 of the sleeve member 31, see FIGS. 9 and 10. The slide member 40 may be moved longitudinally within the slide formed by the sleeve portions 33 and 34. The slide member 40 is a sheet metal rectangular member whose one end is bent up to form a hook-like lip portion 41. That hook-like portion 41 may be engaged with the hook-like portion 17. The flat portion 42 of the slide member 40 has an elongated cam opening 43. A second generally U-shaped opening 44 in flat portion 42 forms a flexible and resilient tongue 45 having a small raised boss 46 at its end. The flat portion between the hook-like portion 41 and opening 44 may be lengthened to form a blade.

Figure 6:
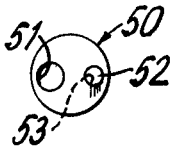

A first disk member 50 is round in top view and its diameter is slightly less than the diameter of the opening 37, so that it fits within the opening 37, see FIG. 6. The first disk member 50 has a round hole 51 and a small protruding boss 52. The first disk member has an indentation 53 on its side opposite boss 52 and aligned therewith. The boss 46 on tongue 45 removably fits in indentation 53 as a detent when the slide member 40 is withdrawn.

Figure 5:
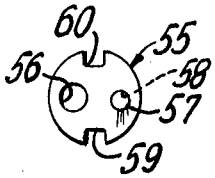

A second disk member 55, round in top view, has a slightly larger diameter than the diameter of the first disk member 50, see FIG. 5. The second disk 55 rides on top of the boss 39 and not within the opening 37. The second disk member 55 has a round hole 56 which is of the same diameter as the hole 51. It also has a small raised boss 57 and a small indentation 58 behind the boss 57. The boss 52 of disk member 50 fits within the indentation 58. The second disk member 55 has opposite side indentations 59 and 60.

Figure 4:
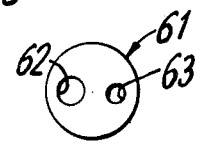

A third disk member 61 is of spring metal, for example, sheet metal of spring steel, and has a hole 62 which is of the same diameter as the holes 56 and 61, see FIG. 4. The third disk member 61 has a smaller hole 63 within which the boss 57 fits.

The interlocking of the three disk members 50, 55 and 61, so that they rotate together as a unit and without slippage, is accomplished by the bosses 52 and 57 which fit within indentation 58 and hole 63, respectively.

The turn member 20 also includes a butterfly member having wing handles as its turning means 65 and having inwardly protruding and opposed fingers 66 and 67 which are square in cross-section and fit within the indentations 69 and 59, respectively, see FIG. 3. The third disk member 61 holds the turning means in position and exerts spring pressure on its square fingers 66,67 to tend to restore the turning means to either a flat or a raised position.

A rivet 70 having a head 71 is utilized to connect and hold the turn in assembly, and the shank is the eccentric cam. The enlarged rivet head 71 is sufficiently large so that its diameter is greater than the width of the elongated opening 43, which prevents the rivet from being pulled through the opening 43. The shank 72 of the rivet 70 protrudes through the opening 43 and also protrudes through the holes 51, 56 and 62. The top of the rivet (the end opposite the head 71) is peened over and forms an enlarged head above the hole 62 to hold the three disks 61, 55 and 50 together. The rivet 70 is the eccentric cam means of the turn member and, when the turning means 65 is turned a half-turn, will move within the cam opening 43 and be rotated about the imaginary center of the opening 37. The shank 72 is off-set and eccentric in relationship to the center of opening 37.

In operation, starting with the slide plate member 40 in its extended position, the user will rotate the sleeve member 31 on its hinge means until the hook-like portion 41 of the slide plate member 40 grips the hook-like portion (keeper lip) 17. The user then turns the turning means 65 a half-turn clockwise, viewed looking down upon it. The rivet 70 is turned clockwise about the imaginary center of the three disk members, those disk members being aligned so that their centers lie on a common imaginary line. The rivet shank 72 pushes on the cam opening 43 and cams the withdrawal of the slide member 40 within the guide-ways of the side sleeve portions 33,34. At the end of the turning motion the slide member is completely withdrawn and the boss 46 moves into the indentation 53.

To unlock the fastener the operation is reversed. The user turns the turning means 65 counterclockwise, causing the rivet shank 72 to rotate and thereby cam the slide member 40 to its extended position and turn the indentation 53 away from the boss 46.

Modifications may be made in the above-described embodiment within the scope of the invention and within the scope of the sub-joined claims. For example, the wing handle of the turning means 65 may be replaced by alternative rotary members such as a screw driver slot in third disk member 61 or a hex nut fastened on top of third disk member 61. Another example of such a modification is the replacement of pin 29 by a wire spring which extends through holes 27,28 and tubular portion 32 and has its ends beyond the flange portions 25,26 as shown in U.S. Pat. No. 2,820,995. Such a spring-mounted actuator may compensate for mounting inaccuracies and irregularities in the sealing surface or a gasket. As still a further such modification, the pivot-carrying base member may be recessed, as in U.S. Pat. No. 2,853,752, or have integral protective slide flange portions.

The industrial fastener of the present invention may be used as a hinge-lock fastener. In such a hinge-lock fastener the turn member is fastened to one panel and the keeper plate is fixed to a blade portion of the slide member and fastened to a second panel. The fastener pivots about its hinge means and the panels are drawn closer together upon withdrawal of the slide member.

What is claimed is:

1. An industrial fastener comprising a keeper plate member to be fastened to one panel and a turn member to be fastened to another panel;

said turn member comprising a base member, a sleeve member having a central portion having therein an opening and opposed side portions forming a sleeve, and hinge means connecting said base member and said sleeve member to permit turning motion of said sleeve member relative to said base member;

said turn member further comprising a slide member which slides within said sleeve, to be extended or withdrawn, and has an elongated cam opening;

a first disk member of sheet metal having a hole therethrough, which first disk fits within the opening in said sleeve member and is rotatable therein;

a second disk member of sheet metal having opposed side indentations and a hole therethrough.

a third disk member of resilient steel having a hole therethrough;

a cam member connected through said holes in said first disk member, said second disk member and said third disk member to connect said three disks together, said cam member protruding through said sleeve member opening and said cam opening; said cam member being eccentric as to the center of said first disk;

turning means having finger portions which fit in said indentations and which turning means may be turned to move said cam member about the said center of said sleeve member opening and within said cam opening to thereby slide and withdraw said slide member and pull together said hook-like member and said turn member.

2. An industrial fastener comprising a keeper plate member to be fastened to one panel and a turn member to be fastened to another panel;

said turn member comprising a base member, a sleeve member having a central portion having therein an opening and opposed side portions forming a sleeve, and hinge means connecting said base member and said sleeve member to permit turning motion of said sleeve member relative to said base member;

said turn member further comprising a slide member which slides within said sleeve, to be extended or withdrawn, and has an elongated cam opening;

a first disk member of sheet metal having a hole therethrough, which first disk fits within the opening in said sleeve member and is rotatable therein;

a second disk member of sheet metal having a hole therethrough;

a third disk member of resilient steel having a hole therethrough;

a cam member connected through said holes in said first disk member, said second disk member and said third disk member to connect said three disks together, said cam member protruding through said sleeve member opening and said cam opening;

turning means which may be turned to move said cam member about the said center of said sleeve member opening and within said cam opening to thereby slide and withdraw said slide member and pull together said hook-like member and said turn member;

wherein said slide member has a resilient integral tongue portion between said hook-like portion and said cam opening, said tongue portion carrying a boss; and said first disk member has an indentation on its bottom face within which said boss is removably fitted upon complete withdrawal of said slide member.

3. An industrial fastener comprising a keeper plate member to be fastened to one panel and a turn member to be fastened to another panel;

said turn member comprising a base member, a sleeve member having a central portion having therein an opening and opposed side portions forming a sleeve, and hinge means connecting said base member and said sleeve member to permit turning motion of said sleeve member relative to said base member;

said turn member further comprising a slide member which slides within said sleeve, to be extended or withdrawn, and has an elongated cam opening;

a first disk member of sheet metal having a hole therethrough, which first disk fits within the opening in said sleeve member and is rotatable therein;

a second disk member of sheet metal having a hole therethrough;

a third disk member of resilient steel having a hole therethrough;

a cam member connected through said holes in said first disk member, said second disk member and said third disk member to connect said three disks together, said cam member protruding through said sleeve member opening and said cam opening;

turning means which may be turned to move said cam member about the said center of said sleeve member opening and within said cam opening to thereby slide and withdraw said slide member and pull together said hook-like member and said turn member;

wherein said cam means is a rivet having a shank portion which protrudes through the three disk members and also protrudes through said cam opening and the sleeve member opening; said rivet having an enlarged head larger than the cam opening on one of its ends and an enlarged head above the third disk member on its other end.

4. An industrial fastener as in claim 3 wherein said slide member has a hook-like portion and said keeper plate has a hook-like portion, the two hook-like portions being removably connected.

5. An industrial fastener as in claim 3 wherein said hinge means comprises opposed flange portions of said base member each having a hole therethrough, said sleeve member having a tubular portion, and a pin through said flange holes and tubular portion.

6. An industrial fastener as in claim 3 wherein said first disk member has a top boss and said second disk member has an indentation in which said boss is fixed.

7. An industrial fastener as in claim 3 wherein said third disk member has a second hole and said second disk member has a top boss which is fixed into said second hole.

8. An industrial fastener comprising a keeper plate member to be fastened to one panel and a turn member to be fastened to another panel;

said turn member comprising a base member, a sleeve member having a central portion having therein an opening and opposed side portions forming a sleeve, and hinge means connecting said base member and said sleeve member to permit turning motion of said sleeve member relative to said base member;

said turn member further comprising a slide member which slides within said sleeve, to be extended or withdrawn, and has an elongated cam opening;

a first disk member of sheet metal having a hole therethrough, which first disk fits within the opening in said sleeve member and is rotatable therein;

a second disk member of sheet metal having a hole therethrough;

a third disk member of resilient steel having a hole therethrough;

a cam member connected through said holes in said first disk member, said second disk member and said third disk member to connect said three disks together, said cam member protruding through said sleeve member opening and said cam opening;

turning means which may be turned to move said cam member about the said center of said sleeve member opening and within said cam opening to thereby slide and withdraw said slide member and pull together said hook-like member and said turn member.

* * * * *